US009052105B2

(12) United States Patent
Zalon

(10) Patent No.: US 9,052,105 B2
(45) Date of Patent: Jun. 9, 2015

(54) ILLUMINATED DRINKING VESSEL

(71) Applicant: SPARK STUDIOS, LLC, Fairfield, CT (US)

(72) Inventor: Paul Zalon, Fairfield, CT (US)

(73) Assignee: SPARK STUDIOS, LLC, Fairfield, CT (US)

( * ) Notice: Subject to any disclaimer, the term of this patent is extended or adjusted under 35 U.S.C. 154(b) by 107 days.

(21) Appl. No.: 13/863,116

(22) Filed: Apr. 15, 2013

(65) Prior Publication Data

US 2013/0271963 A1 Oct. 17, 2013

Related U.S. Application Data

(60) Provisional application No. 61/623,904, filed on Apr. 13, 2012.

(51) Int. Cl.
*F21V 33/00* (2006.01)
*A47G 19/22* (2006.01)

(52) U.S. Cl.
CPC ..... *F21V 33/0036* (2013.01); *A47G 2019/2238* (2013.01); *A47G 19/2288* (2013.01)

(58) Field of Classification Search
CPC ..... F21V 33/0036
USPC ..... 362/96, 101, 311.14, 296
See application file for complete search history.

(56) References Cited

U.S. PATENT DOCUMENTS 2,510,237 A * 6/1950 Mahoney ..... 40/324
2,577,030 A * 12/1951 Neumann ..... 250/487.1
2,604,579 A 7/1952 Deneboudes
4,344,113 A * 8/1982 Ditto et al. ..... 362/101
5,553,735 A * 9/1996 Kimura ..... 362/101
6,062,380 A 5/2000 Dorney
6,213,616 B1 4/2001 Chien
6,443,589 B1 9/2002 Lee
6,591,524 B1 7/2003 Lewis et al.
6,619,811 B2 9/2003 Wang et al.
6,651,365 B1 11/2003 Wainwright
6,746,132 B2 * 6/2004 Liu ..... 362/101
6,762,734 B2 7/2004 Blotky et al.
6,921,179 B2 7/2005 Diak Ghanem
2003/0147234 A1 8/2003 Harada et al.
2005/0207141 A1 9/2005 Boesch et al.

* cited by examiner

*Primary Examiner* — Ali Alavi
(74) *Attorney, Agent, or Firm* — Berenato & White, LLC

(57) ABSTRACT

A drinking vessel comprises a waterproof double-walled body member defining an enclosed hollow space therewithin, illumination means and a flexible substrate supporting the illumination means disposed in the enclosed hollow space, a source of electrical energy to the illumination means and a power switch mounted to the double-walled body member and including a mechanical switch pin extendable from and retractable into a bottom portion of the body member. The mechanical switch pin is operable between a first position when the drinking vessel is disposed on a supporting surface, in which the mechanical switch pin is retracted into the bottom portion and the power switch is in an electrically open state, and a second position when the drinking vessel is lifted from the supporting surface, in which the mechanical switch pin is extended from the bottom portion and the power switch is in an electrically closed state.

12 Claims, 3 Drawing Sheets

ILLUMINATED DRINKING VESSEL

CROSS-REFERENCE TO RELATED APPLICATIONS

This application claims the benefit of priority of provisional application 61/623,904 filed on Apr. 13, 2012 by Paul Zalon, which is hereby incorporated herein by reference in its entirety and to which priority is claimed.

BACKGROUND OF THE INVENTION

1. Field of the Invention

The present invention relates to illuminated containers in general and, more particularly, to a drinking vessel illuminated by lighting elements.

2. Description of the Related Art

Insulated cups and containers of various size and shape are well known in the art. Moreover, the use of a double-wall construction to provide insulation to a drinking cup is known. Typically, insulated cups of double-wall construction are made of a polycarbonate or other plastic composition and include an inner wall, an outer wall and a void between the walls. Usually, the inner and outer walls are joined at or near a top rim and, in some cases, the walls are transparent. Also known are insulated drinking vessels, which incorporate luminescent means for enhancing the visibility of the drinking vessel and for displaying decorative or informative items and means. However, conventional drinking vessels with means for enhancing the visibility thereof and for displaying decorative or informative items are susceptible to improvements. With this in mind, a need exists to develop a drinking vessel with illuminated display that advances the art.

SUMMARY OF THE INVENTION

The present invention is directed to a drinking vessel for containing a liquid beverage to be consumed therefrom. The drinking vessel comprises a waterproof double-walled body member defining an enclosed hollow space therewithin and having a bottom portion and a peripheral side wall portion upwardly extending from said bottom portion, illumination means and a flexible substrate supporting said illumination means both disposed in said enclosed hollow space, a source of electrical energy to the illumination means disposed in the enclosed hollow space of the double-walled body member, and a power switch mounted to the bottom portion of the double-walled body member and including a mechanical switch pin extendable from and retractable into the bottom portion. The mechanical switch pin is operable between a first position, in which the mechanical switch pin is retracted into the bottom portion and the power switch is in an electrically open state in which the source of electrical energy is disconnected from the illumination means, and a second position, in which the mechanical switch pin is extended from the bottom portion and the power switch is in an electrically closed state in which the source of electrical energy is electrically connected with the illumination means. The power switch is in the first position when the drinking vessel is disposed on a supporting surface, and in the second position when the drinking vessel is lifted from the supporting surface. The mechanical switch pin of the power switch is spring biased to the second position.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DESCRIPTION OF EXEMPLARY EMBODIMENTS

Figure 1:
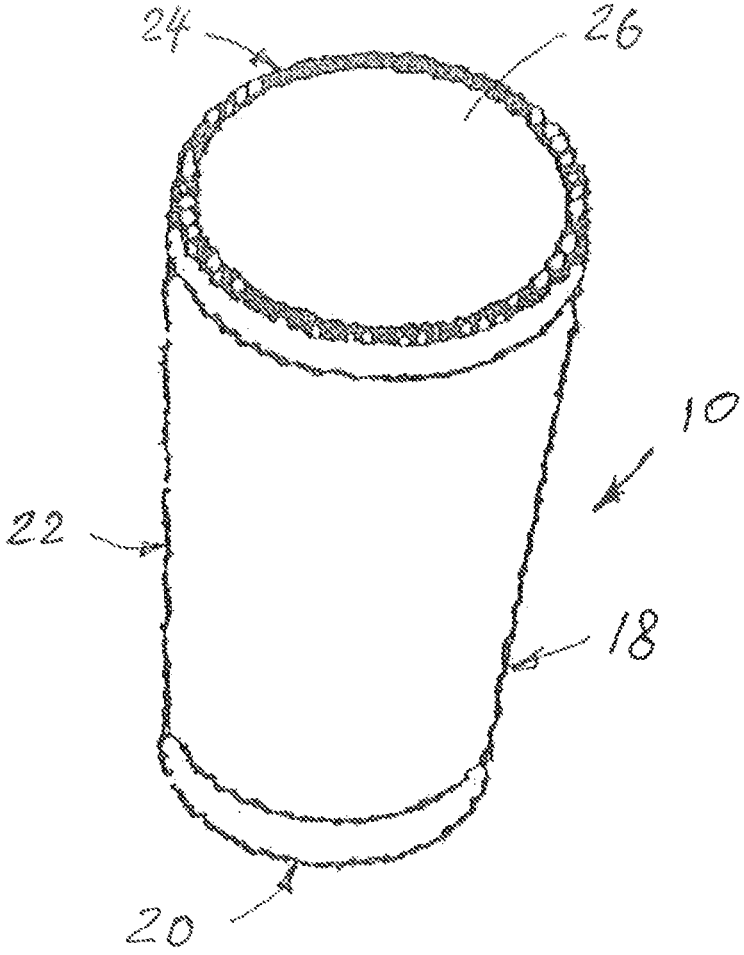
FIG. 1 is a perspective view of a drinking vessel according to an exemplary embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper", "lower", "right", "left", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" as used in the claims means "at least one" and the word "two" as used in the claims means "at least two".

Figure 2:
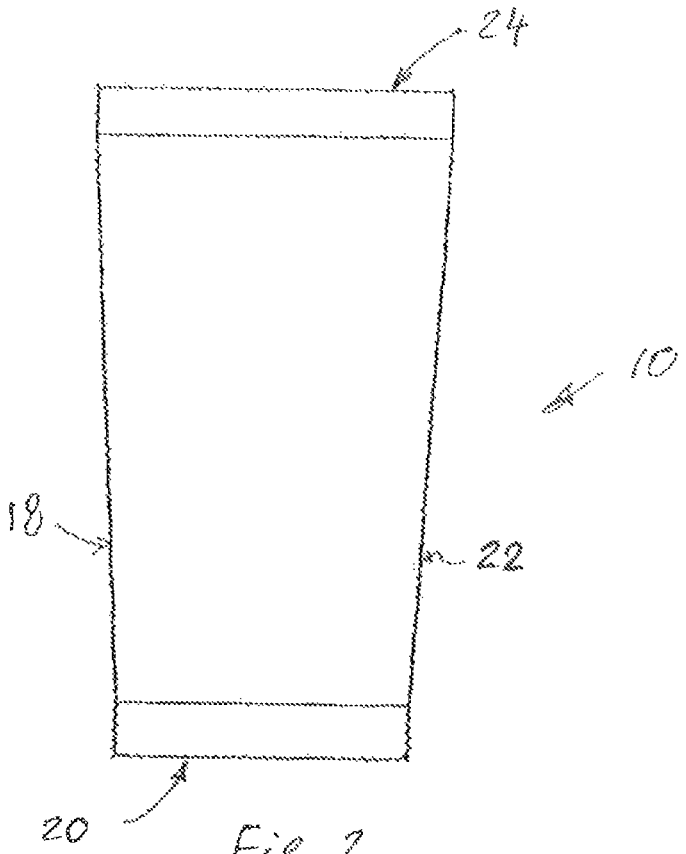
FIG. 2 is a side view of the drinking vessel according to the exemplary embodiment of the present invention.
Figure 3:
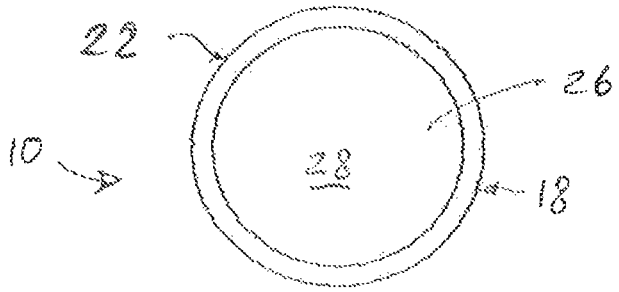
FIG. 3 is a top view of the drinking vessel according to the exemplary embodiment of the present invention.

The present invention is related to a liquid container in the form of a drinking vessel (generally denoted by reference numeral 10) according to an exemplary embodiment of the present invention shown in FIGS. 1-3. The drinking vessel (such as cup, tumbler, and the like) 10 comprises a substantially annular outer body (or outer shell) 12 and a substantially annular inner body (or inner shell) 14 fitted in and located co-axially within the outer body 12. The outer body 12 has an outer wall 12*a* and an outer bottom 12*b*, while the inner body 14 has an inner wall 14*a* and an inner bottom 14*b*.

Figure 4:
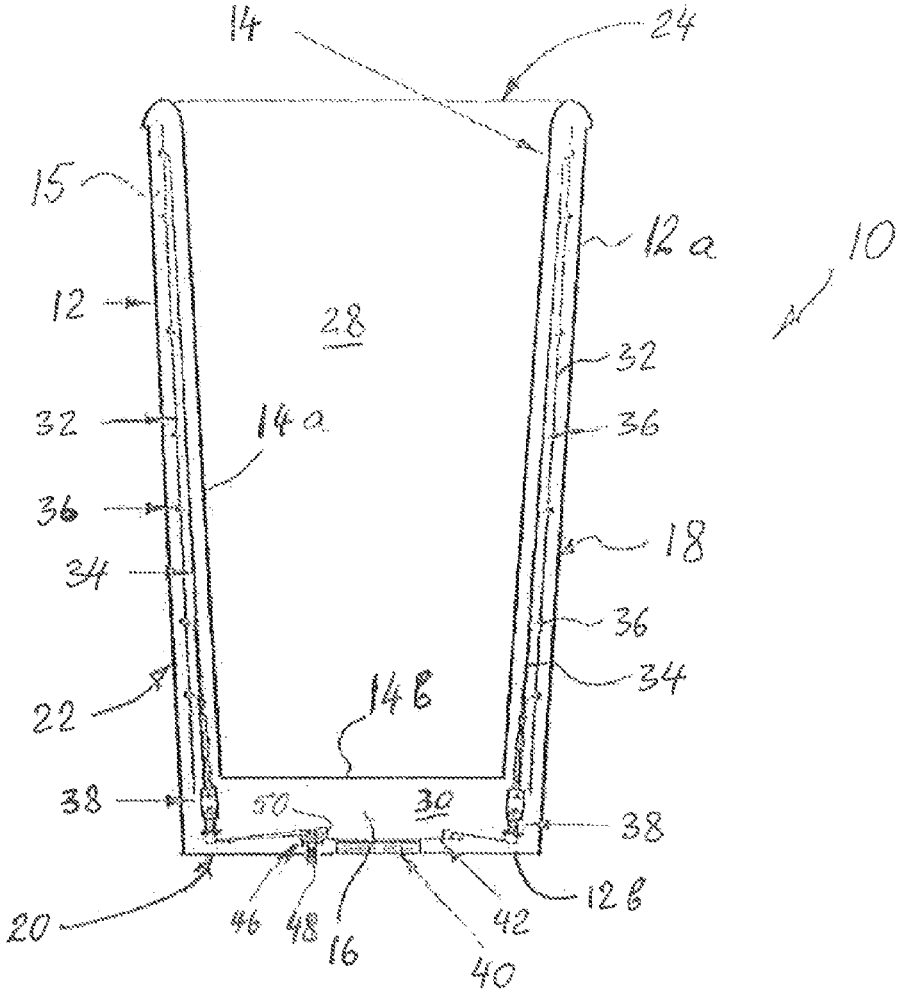
FIG. 4 is a vertical sectional view of the drinking vessel according to the exemplary embodiment of the present invention.

As illustrated in detail in FIG. 4, the outer wall 12*a* is radially spaced from the inner wall 14*a* so as to define a hollow annular wall cavity 15 therebetween, while the outer bottom 12*b* is axially spaced from the inner bottom 14*b* so as to define a hollow bottom cavity 16 therebetween.

In other words, outer and inner bodies 12 and 14, respectively, are connected together so as to form a waterproof double-walled structure defining a waterproof double-walled body member 18 having a bottom portion 20, and a peripheral side wall portion 22 upwardly extending from the bottom portion 20 and terminating at a top rim 24. The top rim 24 surrounds a top opening 26 of the drinking vessel 10, which communicates with an interior chamber 28 of the drinking vessel 10 for holding hot or cold beverage contents therein. In other words, the interior chamber 28 of the drinking vessel 10 is defined by the inner wall 14*a* and the inner bottom 14*b* of the inner body 14. The double-walled body member 18 defines an annular watertight enclosed hollow space 30 therewithin formed between the outer body 14 and the inner body 12 of the body member 18 by the wall cavity 15 and the bottom cavity 16. The watertight hollow space 30 between the outer body 12 and the inner body 14 helps the insulating properties of the drinking vessel 10.

According to the exemplary embodiment of the present invention, the outer wall 12*a* of the outer body 12 is made of transparent, i.e. clear, plastic material, such as poly styrene or poly carbonate, or similar material. It will be appreciated that the outer wall 12*a* of the outer body 12 could be made of any appropriate transparent material, such as glass. Further according to the exemplary embodiment of the present invention, the inner body 14 is made of plastic material, glass or metal, such as stainless steel.

The drinking vessel 10 further comprises a flexible substrate 32 curved so as to fit into the watertight wall cavity 15 between the outer and inner walls 12*a*, 14*a* of the drinking vessel 10. The flexible substrate 32 is made of an appropriate flexible sheet material such as paper, cardboard, plastic or the like. The wall cavity 15 between the outer and inner walls 12*a*, 14*a* of the drinking vessel 10 can also be used to receive an advertising message, corporate logo or any artwork into this narrow cavity 15 visible through the transparent outer wall 12*a* of the outer body 12.

The flexible substrate 32 supports fiber optic strands 34, defining illumination means, also disposed in the wall cavity 15 between the outer and inner walls 12*a*, 14*a* of the drinking vessel 10. Fiber tips 36 of the fiber optic strands 34 extend through the flexible substrate 32 so as to be visible through the transparent outer wall 12*a* of the outer body 12. Therefore, the flexible substrate 32 with the fiber optic strands 34 forms a display panel for producing a continuous animated display of one or more images within a single display frame space utilizing sequenced illumination patterns or arrays of groups of the optical fiber strands 34 for illuminating each of a plurality of sub-frame images in a pre-programmed, timed sequence to achieve one or more animation techniques imparting continuous animated motion to the one or more images for producing the desired animated motion on a planar surface. The structural and functional description of the similar device can be found in U.S. Pat. No. 6,651,365, which is herein fully incorporated by reference. The images are formed by the fiber tips 36 of the fiber optic strands 34 defining a series of illumination points formed in the shape of various ornamental and/or decorative images and/or letters.

These fiber optic strands 34 are bundled together in predetermined groupings and are linked to one or more light of the sources 38 which are disposed in the watertight bottom cavity 16 of the drinking vessel 10 and optically linked to the fiber optic strands 34. The effect is to be able to illuminate the flexible substrate 32 in any manner of methods. In the exemplary embodiment of the present invention, the light sources 38 are light emitting diodes (LEDs). It should be noted that any other appropriate low voltage light sources, which may include colored light emitting diodes or colored lenses placed over the light emitting diodes to produce the desired colors, are within the scope of the present invention. The present invention utilizes the LEDs 38 in the watertight bottom cavity 16 or elsewhere in the watertight hollow space 30 of the drinking vessel 10 to create illumination. The LEDs 38 in the watertight bottom cavity 16 of the drinking vessel 10 are not visible, and exist solely to transmit light up to the tips 36 of the fiber optic strands 34.

Figure 5:
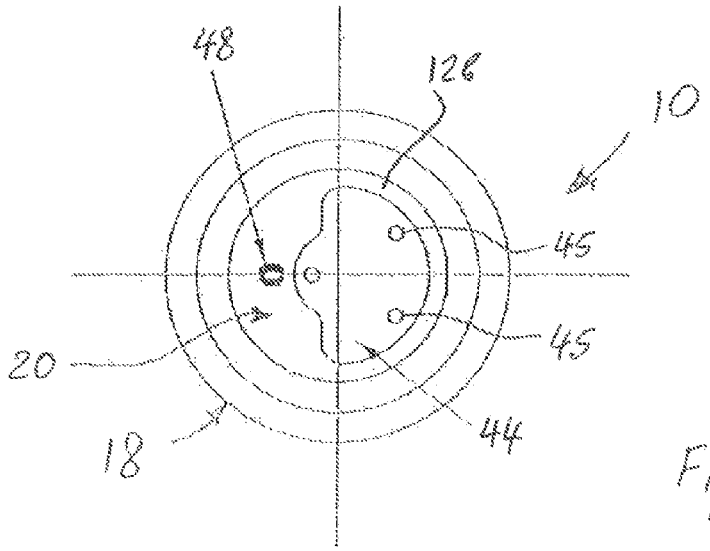
FIG. 5 is a bottom view of the drinking vessel according to the exemplary embodiment of the present invention.

The watertight bottom cavity 16 of the drinking vessel 10 further houses a source of electrical energy 40 to the LEDs 38, which may be in the form of a battery pack or similar portable energy source, a control unit 42, preferably in the form of a printed circuit board (PCB) and IC, for controlling timing and sequencing of illumination of the light sources 38. As noted above, the structural and functional description of the similar animated motion control system can be found in U.S. Pat. No. 6,651,365, which is herein fully incorporated by reference. Moreover, the watertight bottom cavity 16 of the drinking vessel 10 can be opened to replace the battery 40 as needed. According to the exemplary embodiment of the present invention, the battery 40 is mounted inside a waterproof battery case disposed inside the bottom cavity 16 of the drinking vessel 10, which is accessible through a cover 44 (shown in FIG. 5) removably fastened to the outer bottom 12*b* of the outer body 12 through one or more threaded fasteners 45, such as screws.

The drinking vessel 10 further includes a power switch in the form of a mechanical switch 46 including a press button (mechanical switch pin) 48. The power switch 46 is mounted to the bottom portion 20 of the double-walled body member 18. More specifically, the power switch 46 is mounted to the outer bottom 12*b* of the outer body 12 inside the bottom cavity 16 such that the press button 48 can be partially extending through the outer bottom 12*b* of the outer body 12, as illustrated in FIG. 4. In other words, the press button 48 is extendable from the outer bottom 12*b* of the outer body 12 and retractable into the bottom cavity 16.

The press button 48 of the power switch 46 is linearly movable to be operable between a first position, in which the power switch 46 is in an electrically open state, and a second position, in which the power switch 46 is in an electrically closed state. Specifically, when the press button 48 is in the first position, the power switch 46 is in the electrically open state and the source of electrical energy 40 is disconnected from the light sources 38, while when the press button 48 is in the second position, the power switch 46 is in an electrically closed state and the source of electrical energy 40 is electrically connected with the light sources 38.

The press button 48 of the power switch 46 is in the first position when the drinking vessel 10 is disposed on a flat supporting surface, such as a table, so that the press button 48 is retracted into the bottom cavity 16 of the drinking vessel 10 under the force of gravity (i.e., weight) of the drinking vessel 10 acting to the flat supporting surface of the table. In other words, the press button 48 of the power switch 46 in the first position does not extend through the outer bottom 12*b* of the outer body 12 outside the body member 18.

The press button 48 of the power switch 46 is in the second position when the drinking vessel 10 is lifted from the supporting surface, and when, consequently, the press button 48 extends through the outer bottom 12*b* of the outer body 12 outside the bottom cavity 16 under the biasing force of a biasing spring 50 of the power switch 46 acting to the press button 48. In other words, the press button 48 of the power switch 46 is spring biased to the second, extended position.

According to the exemplary embodiment of the present invention, the illuminated image on the flexible substrate 32 is turned on by lifting the drinking vessel 10 off of the flat supporting surface. The light sources 38, thus the illumination of the flexible substrate 32, will turn off by placing the drinking vessel 10 down again on the flat supporting surface. It will also turn off on its own after approx 30 seconds if held off the supporting surface. Moreover, the illumination of the flexible substrate 32 can also turn on by touching the side wall portion 22 of the drinking vessel 10.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A drinking vessel for containing a liquid beverage to be consumed therefrom, said drinking vessel comprising:

a waterproof double-walled body member having a bottom portion and a peripheral side wall portion upwardly extending from said bottom portion, said double-walled body member defining an enclosed hollow space therewithin;

illumination means and a flexible substrate supporting said illumination means both disposed in said enclosed hollow space;

a source of electrical energy to said illumination means, said source of electrical energy disposed in said enclosed hollow space; and a power switch mounted to said bottom portion of said double-walled body member and including a mechanical switch pin extendable from and retractable into said bottom portion;

said mechanical switch pin operable between a first position, in which said mechanical switch pin being retracted into said bottom portion and said power switch being in an electrically open state in which said source of electrical energy being disconnected from said illumination means, and a second position, in which said mechanical switch pin being extended from said bottom portion and said power switch being in an electrically closed state in which said source of electrical energy being electrically connected with said illumination means;

said power switch being in said first position when said drinking vessel is disposed on a supporting surface;

said power switch being in said second position when said drinking vessel is lifted from the supporting surface;

said mechanical switch pin of said power switch spring biased to said second position.

2. The drinking vessel as defined in claim 1, wherein said double-walled body member is formed of a substantially annular outer body and a substantially annular inner body fitted in and located co-axially within said outer body.

3. The drinking vessel as defined in claim 2, wherein said outer body has an outer wall and an outer bottom; and wherein said inner body has an inner wall and an inner bottom.

4. The drinking vessel as defined in claim 3, wherein said outer wall is radially spaced from said inner wall so as to define a hollow annular wall cavity therebetween, and wherein said outer bottom is axially spaced from said inner bottom so as to define a hollow bottom cavity therebetween.

5. The drinking vessel as defined in claim 4, wherein said source of electrical energy and said power switch are disposed in said bottom cavity.

6. The drinking vessel as defined in claim 5, wherein in said first position said mechanical switch pin is retracted into said bottom cavity; and wherein in said second position said mechanical switch pin extends from said bottom cavity through said outer bottom of said outer body outside said bottom cavity.

7. The drinking vessel as defined in claim 1, wherein said illumination means includes at least one fiber optic strand supported by said flexible substrate.

8. The drinking vessel as defined in claim 7, wherein said illumination means further includes at least one light source disposed in said enclosed hollow space and optically linked to said at least one fiber optic strand.

9. The drinking vessel as defined in claim 8, wherein said at least one light source is a light emitting diode.

10. The drinking vessel as defined in claim 8, wherein in said first position, in which said power switch is in said electrically open state, said source of electrical energy is disconnected from said at least one light source; and wherein in said second position, in which said power switch is in said electrically closed state, said source of electrical energy is electrically connected with said at least one light source.

11. The drinking vessel as defined in claim 10, further comprising a control unit for controlling timing and sequencing of illumination of said light sources.

12. A drinking vessel for containing a liquid beverage to be consumed therefrom, said drinking vessel comprising:

a waterproof double-walled body member having a bottom portion and a peripheral side wall portion upwardly extending from said bottom portion, said double-walled body member defining an enclosed hollow space therewithin;

illumination means and a flexible substrate supporting said illumination means both disposed in said enclosed hollow space;

a source of electrical energy to said illumination means, said source of electrical energy disposed in said enclosed hollow space; and a power switch mounted to said double-walled body member;

said power switch operable between a first position, in which said power switch being in an electrically open state in which said source of electrical energy being disconnected from said illumination means, and a second position, in which said power switch being in an electrically closed state in which said source of electrical energy being electrically connected with said illumination means;

said power switch being in said first position when said drinking vessel is disposed on a supporting surface;

said power switch being in said second position when said drinking vessel is lifted from the supporting surface.

* * * * *